United States Patent [19]

Fendley et al.

[11] Patent Number: 4,766,342

[45] Date of Patent: Aug. 23, 1988

[54] TENSION MASK ASSEMBLY FOR A COLOR CRT

[75] Inventors: James R. Fendley, Arlington Heights; Johann Steiner, Des Plaines; Paul Strauss, Chicago, all of Ill.

[73] Assignee: Zenith Electronics Corporation, Glenview, Ill.

[21] Appl. No.: 942,663

[22] Filed: Dec. 17, 1986

[51] Int. Cl.[4] ..... H01J 29/07

[52] U.S. Cl. ..... 313/402; 313/408; 313/482

[58] Field of Search ..... 313/402, 404, 477 R, 313/407, 408, 482, 269

[56] References Cited

U.S. PATENT DOCUMENTS

| | | | |
|---|---|---|---|
| 2,611,100 | 9/1952 | Faulkner et al. | 313/404 |
| 2,625,734 | 1/1953 | Law | 29/25.13 |
| 2,733,366 | 1/1956 | Grimm et al. | 313/408 X |
| 2,842,696 | 7/1958 | Fischer-Colbrie | 313/78 |
| 2,905,845 | 9/1959 | Vincent | 313/78 |
| 3,030,536 | 4/1962 | Hackett et al. | 313/80 |
| 3,284,655 | 11/1966 | Oess | 313/286 |
| 3,638,063 | 1/1972 | Tachikawa et al. | 313/348 |
| 3,727,087 | 4/1973 | Steinberg et al. | 313/91 |
| 3,894,321 | 7/1975 | Moore | 29/25.13 |
| 4,045,701 | 8/1977 | Dougherty | 313/402 |
| 4,069,567 | 1/1978 | Schwartz | 29/25.15 |
| 4,087,717 | 5/1978 | Lerner | 313/406 |
| 4,100,451 | 7/1978 | Palac | 313/404 |
| 4,122,368 | 10/1978 | Masterton | 313/407 X |

OTHER PUBLICATIONS

Robinder et al., "A High-Brightness Shadow-Mask Color CRT for Cockpit Displays", Tektronix, Inc., Beaverton, OR, 1983 SID Digest.

Fyler et al., "The CBS-Colortron: A Color Picture Tube of Advanced Design" Proceedings of the IRE.

*Primary Examiner*—David K. Moore

*Assistant Examiner*—Michael Horabik

[57] ABSTRACT

An improved front assembly for a color cathode ray tube having a tension foil shadow mask is disclosed. The faceplate of the tube has on its inner surface a centrally disposed phosphor screen surrounded by a peripheral sealing area adapted to mate with a funnel. A shadow mask support structure is provided for securing a shadow mask in tension on the structure and spacing the shadow mask from the screen. The support structure includes an undulated strip defining a bottom sinuous edge for securing the support structure to the faceplate and a top sinuous edge for securing the shadow mask to the support structure. A cap may be provided for securement to the top sinuous edge of the undulated strip to provide a land for securing the shadow mask to the support structure.

24 Claims, 5 Drawing Sheets

TENSION MASK ASSEMBLY FOR A COLOR CRT

CROSS REFERENCE TO RELATED APPLICATIONS

This application is related to but in no way dependent upon copending applications Ser. No. 832,493, filed Feb. 21, 1986; Ser. No. 831,699, filed Feb. 21, 1986; Ser. No. 832,556, filed Feb. 21, 1986; Ser. No. 835,845, filed Mar. 3, 1986; Ser. No. 866,030, filed May 21, 1986; Ser. No. 925,656, filed Oct. 29, 1986; Ser. No. 923,934, filed Oct. 28, 1986; Ser. No. 942,336, filed Dec. 16, 1986; and Ser. No. 925,345, filed Oct. 31, 1986; all of common ownership herewith.

FIELD OF THE INVENTION

This invention generally relates to color cathode ray picture tubes and, specifically, to a novel front assembly for color tubes that have a tension foil shadow mask. The invention is useful in color tubes of various types including those used in home entertainment television receivers, and those used in medium-resolution and high-resolution tubes intended for color monitors.

BACKGROUND OF THE INVENTION

The use of the tension foil mask and a flat faceplate provides many advantages and benefits in comparison with the conventional curved or domed shadow mask. Chief among these is a greater power-handling capability which makes possible as much as a three-fold increase in brightness. The conventional curved shadow mask, which is not under tension, tends to "dome" in high-brightness picture areas where the intensity of electron bombardment is greatest. Color impurities result as the mask moves closer to the faceplate. Being under high tension, the tension foil mask does not dome or otherwise move in relation to the faceplate. Therefore, it has greater brightness potential while maintaining color purity.

The tension foil shadow mask is a part of the cathode ray tube front assembly, and is located in close adjacency to the faceplate. The front assembly comprises the faceplate with its deposits of light-emitting phosphors, a shadow mask, and support means for the mask. As used herein, the term "shadow mask" means an apertured metallic foil which may have a thickness, by way of example, of about one mil or less. The mask must be supported in high tension a predetermined distance from the inner surface of the cathode ray tube faceplate. This distance is known as the "Q-distance." The high tension may be in the range of 20 to 40 kpsi. As is well known in the art, the shadow mask acts as a color-selection electrode, or parallax barrier, which ensures that each of the three color beams lands only on its assigned phosphor deposits.

The requirements for the support means for the shadow mask are stringent. As has been noted, the shadow mask must be mounted under high tension. The mask support means must be of high strength so that the mask is held immovable. An inward movement of the mask of as little as one-tenth of a mil is significant in that guard band may be expended. Also, the shadow mask support means must be of such configuration and material composition as to be compatible with the means to which it is attached. As an example, if the support means is attached to glass such as the inner surface of the faceplate, the support means must have about the same thermal coefficient of expansion as that of the glass. The support means must provide a suitable surface for mounting the mask. Also, the support means must be of a composition such that the mask can be welded onto it by electrical resistance welding or by laser welding. The support surface preferably is of such flatness that no voids can exist between the metal of the mask and the support structure to prevent the intimate metal-to-metal contact required for proper welding.

A tension mask registration and supporting system is disclosed by Strauss in U.S. Pat. No. 4,547,696 of common ownership herewith. A frame dimensioned to enclose the screen comprises first and second space-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. When the system is assembled, the frame is located between the sealing lands of the faceplate and a funnel, with the stiffening member projecting from the frame into the funnel. While the system is feasible and provides an effective means for holding a mask under high tension and rigidly planoparallel with a flat faceplate, weight is added to the cathode ray tube, and additional process steps are required in manufacture.

There exists in the marketplace today a color tube that utilizes a tensed shadow mask. The mask is understood to be placed under high tension by purely mechanical means. Specifically, a very heavy mask support frame is compressed prior to and during affixation of the mask to it. Upon release of the frame, restorative forces int he frame cause the mask to be placed under high residual tension. During normal tube operation, electron beam bombardment causes the mask to heat up and the mask tension to be reduced. An upper limit is placed on the intensity of the electron beams that may be used to bombard the screen without causing the mask to relax completely and lose its color selection capability. The upper limit has been found to be below that required to produce color pictures of the same brightness as are produced in tubes having non-tensed shadow masks. For descriptions of examples of this type of tube, see U.S. Pat. No. 3,638,063 to Tachikawa.

Other prior art include: Lerner U.S. Pat. No. 4,087,717; Dougherty U.S. Pat. No. 4,045,701; Palac U.S. Pat. No. 4,100,451; Law U.S. Pat. No. 2,625,734; Steinberg et al U.S. Pat. No. 3,727,087; Schwartz U.S. Pat. No. 4,069,567; Moore U.S. Pat. No. 3,894,321; Oess U.S. Pat. No. 3,284,655; Hackett U.S. Pat. No. 3,303,536; Hackett et al U.S. Pat. No. 3,030,536; Vincent U.S. Pat. No. 2,905,845; Fischer-Colbrie U.S. Pat. No. 2,842,696; Law U.S. Pat. No. 2,625,734; a journal article: "The CBS Colortron: A color picture tube of advanced design." Fyler et al. Proc. of the IRE, Jan. 1954. Dec. class R583.6; and a digest article: "A High-Brightness Shadow-Mask Color CRT for Cockpit Displays." Robinder et al. Society for Information Display, 1983.

OBJECTS OF THE INVENTION

A general object of the invention is to provide an improved front assembly for tension foil shadow mask tubes.

Another general object of the invention is to provide a tension foil shadow mask support structure that is low in cost and light in weight.

A further object of the invention is to provide a tension foil shadow mask support structure that can be mounted on a faceplate for receiving a tension foil shadow mask.

Still another object of the invention is to provide a tension foil shadow mask support structure that is capable of holding a tension foil shadow mask firmly in registration under high electron beam bombardment.

Yet a further object of the invention is to provide a tension foil shadow mask support structure that simplifies manufacture and lowers manufacturing costs.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENT

Figure 1:
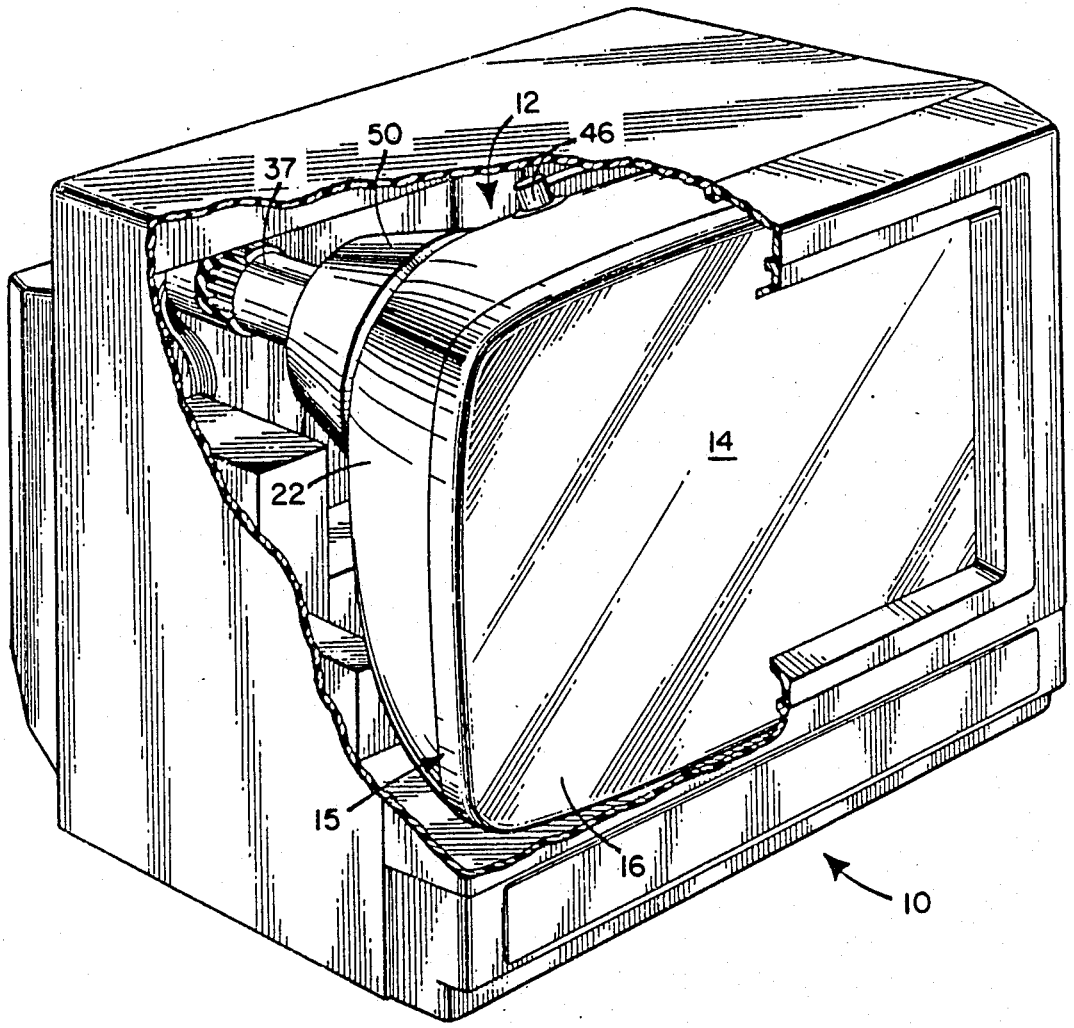
FIG. 1 is a cut-away perspective view of a cabinet housing a cathode ray tube having a front assembly according to the invention.

FIG. 1 depicts a video monitor, generally designated 10, that houses a color cathode ray tube, generally designated 12, having a novel front assembly according to the invention. The design of the video monitor is the subject of copending design patent application Ser. No. 725,040 of common ownership herewith. The monitor-associated tube is notable for the flat imaging area 14 that makes possible the display of images in undistorted form. Imaging area 14 also offers a more efficient use of screen area as the corners are relatively square in comparison with the more rounded corners of the conventional cathode ray tube. The front assembly according to the invention comprises the components described in the following paragraphs.

Figure 2:
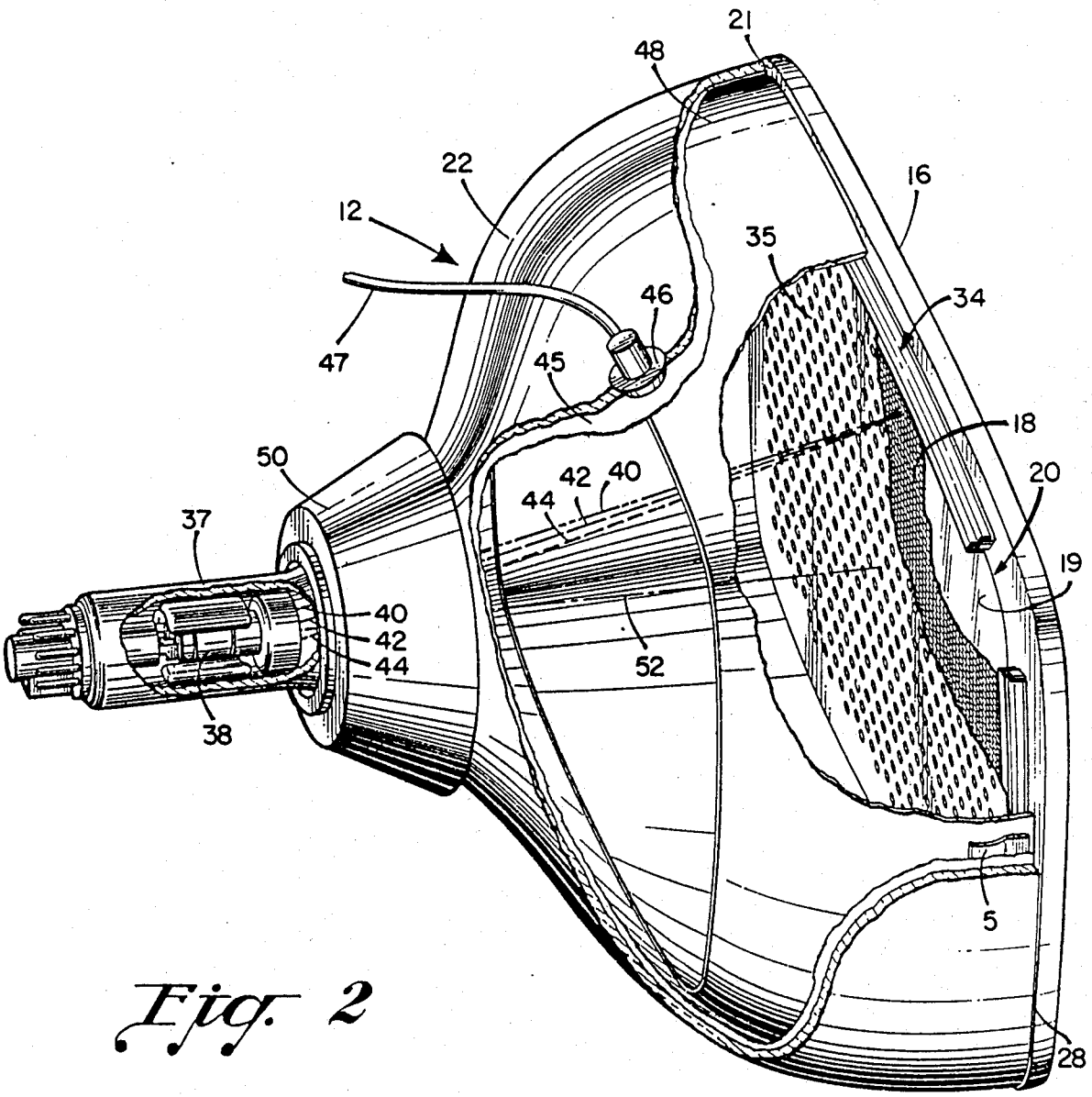
FIG. 2 is a cut-away side perspective view of the color cathode ray tube of FIG. 1, illustrating the location of a shadow mask support structure incorporating the concepts of the invention.
Figure 3:
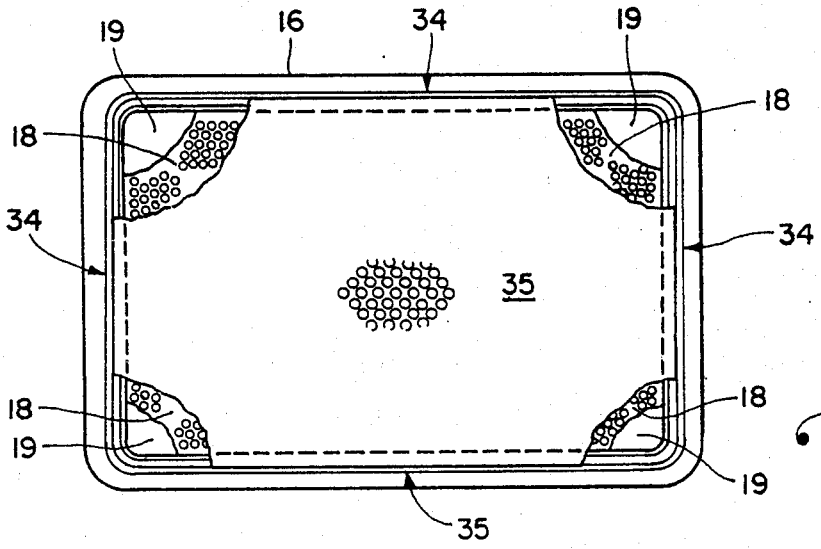
FIG. 3 is a plan view showing the relationship of the shadow mask support structure to the inner surface of the cathode ray tube faceplate shown in FIG. 2.
Figure 4:
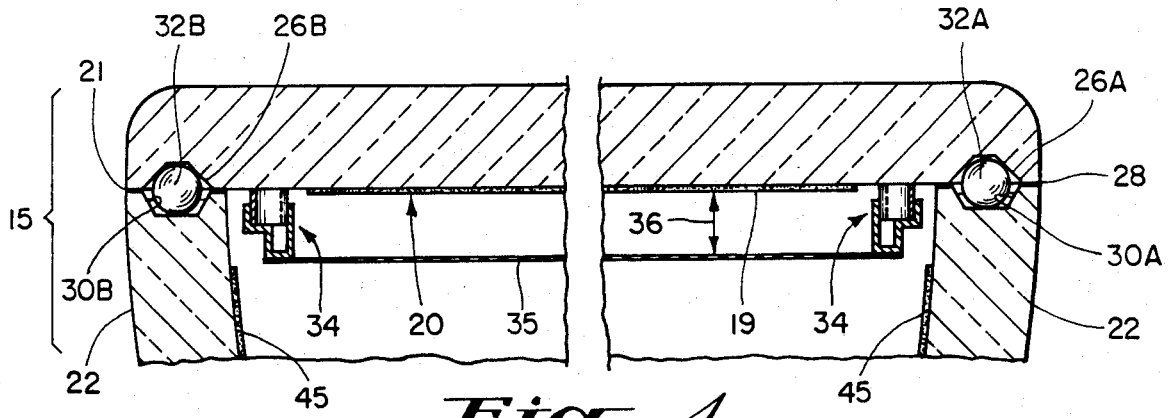
FIG. 4 is a broken section, on an enlarged scale, taken through the front assembly generally on the axis of the cathode ray tube.

With reference also to FIGS. 2, 3 and 4, a front assembly 15 (FIG. 4) for a high-resolution color cathode ray tube is depicted, the general scope of which is indicated by the bracket. Front assembly 15 includes a glass faceplate 16 noted as being flat, or alternately, "substantially" flat in that it may have finite horizontal and vertical radii. Faceplate 16, depicted in this embodiment of the invention as being planar and flangeless, has on its inner surface a centrally disposed phosphor target area 18, on which is deposited an electrically conductive film 19. Phosphor target area 18 and conductive film 19 comprise the electron beam target area, commonly termed a "screen," generally designated 20, which serves, during manufacture, for receiving a uniform coat of phosphor slurry. Conductive film 19, which is deposited on the phosphor deposite in a final step, typically consists of a very thin, light-reflective, electron-pervious film of aluminum.

Screen 20 is surrounded by a peripheral sealing area 21 adapted to be mated with a funnel 22. Sealing area 21 is represented as having three substantially radially oriented first indexing V-grooves therein, only two grooves 26A and 26B being shown in FIG. 4. The indexing grooves preferably are peripherally located at equal angular intervals about the center of faceplate 16; that is, at 120-degree intervals. Indexing grooves 26A and 26B are shown in FIG. 4. The third indexing groove is not shown; however, it is also located in peripheral sealing area 21 equidistantly from indexing elements 26A and 26B. The V-shaped indexing grooves provide for indexing faceplate 16 in conjunction with a mating envelope member, as will be shown.

Funnel 22 has a funnel sealing area 28 with second indexing elements or grooves 30A and 30B therein in like orientation, and depicted in FIG. 4 in facing adjacency with the first indexing elements 26A and 26B. Ball means 32A and 32B, which provide complementary rounded indexing means, are conjugate with the indexing grooves or elements 26A and 26B and 30A and 30B for registering the faceplate 16 and the funnel 22. The first indexing elements together with the ball means are also utilized as indexing means during the photoscreening of the phosphor deposits on the faceplate.

Front assembly 15 according to the invention includes a tension foil mask support structure, generally designated 34, secured to the inner surface of faceplate 16 between screen 20 and peripheral sealing area 21 and enclosing the phosphor target 18. The support structure provides for supporting a tension foil shadow mask 35 a predetermined "Q-distance" from the inner surface of faceplate 16. The predetermined distance may comprise the "Q-distance" 36, as indicated by the associated arrow in FIG. 4. The mask, indicated as being planar, is depicted as being stretched in all directions in the plane of the mask.

As seen in FIG. 2, a neck 37 extending from funnel 22 is represented as housing an electron gun 38 which is indicated as emitting three electron beams 40, 42 and 44 that selectively activate phosphor target 18, noted as comprising colored-light emitting phosphor deposits overlayed with a conductive film 19. Beams 40, 42 and 44 serve to selectively activate the pattern of phosphor deposite after passing through the parallax barrier formed by shadow mask 35.

Funnel 22 is indicated as having an internal electrically conductive funnel coating 45 adapted to receive a high electrical potential. The potential is depicted as being applied through an anode button 46 attached to a conductor 47 which conducts a high electrical potential to the anode button 46 through the wall of funnel 22. The source of the potential is a high-voltage power supply (not shown). The potential may be, for example, in the range of 18 to 26 kilovolts in the illustrated monitor application. Means for providing an electrical connection between the electrically conductive support structure 34 and funnel coating 45 may comprise spring means "S" (depicted in FIG. 2).

A magnetically permeable internal magnetic shield 48 is shown as being attached to support structure 34. Shield 48 extends into funnel 22 a predetermined distance 49 which is calculated so that there is no interference with the excursion of the electron beams 40, 42 and 44, yet maximum shielding is provided.

A yoke 50 is shown as encircling tube 12 in the region of the junction between funnel 22 and neck 37. Yoke 50 provides for the electromagnetic scanning of beams 40, 42 and 44 across the screen 20. The center axis 52 of tube 12 is indicated by the broken line.

Figure 5:
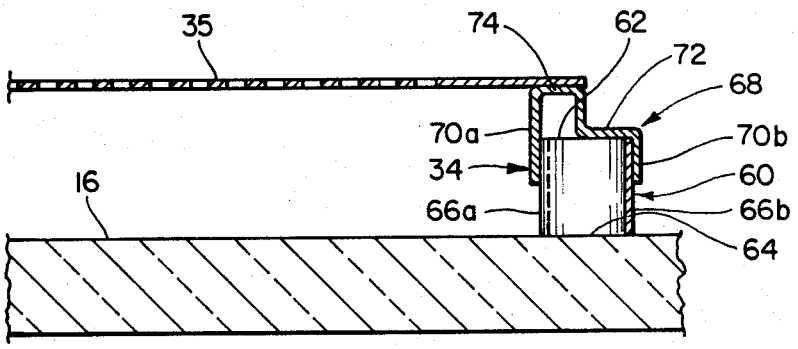
FIG. 5 is a fragmented section through the front assembly illustrating, on an enlarged scale, one end of the shadow mask support structure of the invention.
Figure 6:
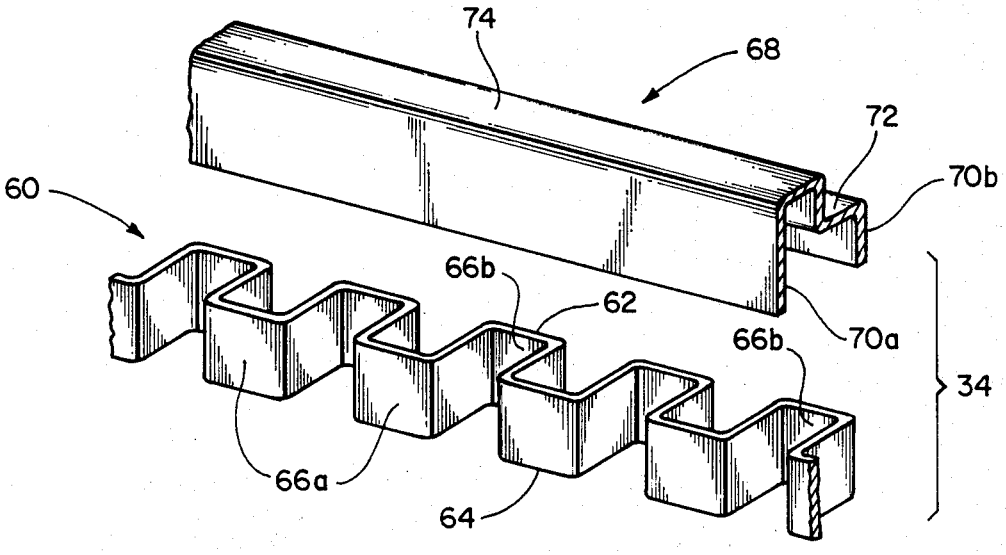
FIG. 6 is a fragmented, exploded perspective view, of the undulated member and cap of the shadow mask support structure.

Referring to FIGS. 5 and 6 in conjunction with the previously described figures, particularly FIG. 4, the shadow mask support structure 34 of this invention is formed from a strip of conductive metal, generally designated 60, which is in an undulated configuration defining a top sinuous edge 62 and a bottom sinuous edge 64. Bottom edge 64 provides means for securing the support structure to faceplate 16. Top edge 62 provides means for securing shadow mask 35 to the support structure. The undulated strip has a generally uniform width (i.e., height in a direction between the faceplate and the shadow mask) whereby top sinuous edge 62 is disposed in a plane generally parallel to the faceplate. The sides of the undulated strip, as at **66*a* and 66*b* are flattened whereby sides 66*a* are disposed in a common plane and sides 66*b* are disposed in a common plane, the planes being generally parallel in a direction perpendicular to the faceplate and the shadow mask. However, it is to be appreciated that the undulated strip can adopt a more serpentine configuration so that a plan view of the strip would exhibit, for example, a "sine-wave" or a "triangular-wave", etc. profile, as contrasted to the "square-wave" depiction in FIG. 6**.

As noted above, top sinuous edge 62 provides the means for securing shadow mask 35 to support structure 34. Therefore, in accordance with a basic practice of the invention, mask 35 can be secured, as by welding, directly to edge 62.

In a particular embodiment of the invention, FIG. 6, a cap, generally designated 68, is positioned over the top of undulated strip 60, i.e., over top sinuous edge 62. Like undulated strip 60, cap 68 is elongated and extends along the sides of phosphor screen 20.

Cap 68 is generally U-shaped with leg portions **70*a* and 70*b* overlying sides 66*a* and 66*b*, respectively, of undulated strip 60. Cap 68 is fabricated of metal material and is secured to undulated strip 60 by weld means between leg portions 70*a*, 70*b* of the cap and sides 66*a*, 66*b*** of the undulated strip. Of course, in the case of the more serpentine configuration above mentioned, the leg portions of the cap would conform to the curvature of such a serpentine strip.

The top of cap 68 has a somewhat "stepped" configuration to include a generally flat portion 72 and an elevated land portion 74. Flat portion 72 rests on top sinuous edge 62 of undulated strip 60, as best seen in FIGS. 4 and 5. Elevated land portion 74 provides a generally planar ridge for securing the shadow mask thereto, as by weld means.

The metal material of undulated strip 60 and cap 68 preferably comprises a "Carpenter #27" chrome-iron alloy that has a coefficient of expansion that substantially matches that of the glass of faceplate 16.

Figure 7:
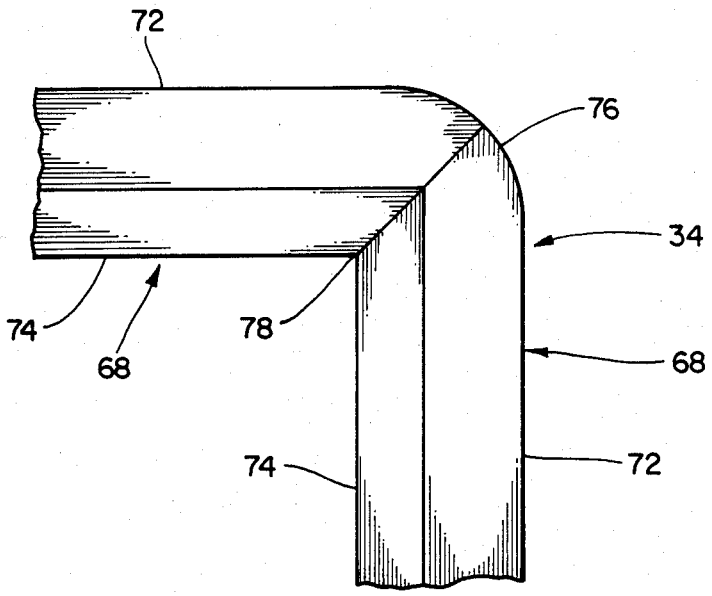
FIG. 7 is a top plan view of the mating corner of a pair of support structures.

Tension foil shadow mask support structure 34 may be disposed along four linear sides of the centrally disposed phosphor screen 20, since the support structure is simply fabricated of two or one strips of metallic material. On the other hand, the support structure may be provided substantially continuous (unbroken) about the centrally disposed phosphor screen. To this end, it can be seen in FIGS. 4–6 that elevated land portion 74 is offset or located along the inside of cap 68, i.e., along the inside of the top sinuous edge 62 nearest the centrally disposed phosphor screen. The advantages of such an inward location are illustrated in FIG. 7 where it can be seen that at the mating of the linear sections of the support structure, i.e., at the corner areas of the phosphor screen, the outside corners are rounded, as at 76. The mating inside corners of the adjacent caps and/or the adjacent end edges of the undulated strips can be secured, as by welding at 78. In this manner, rounding the outer corners of the shadow mask support structure does not interfere with the weld securement. FIG. 2 shows the shadow mask support structure continuously surrounding the centrally disposed phosphor screen 20.

Figure 8:
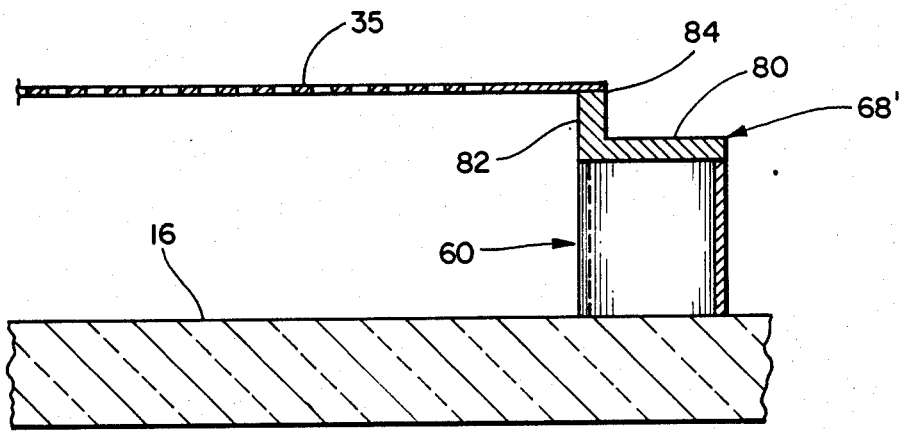
FIG. 8 is a broken section, similar to that of FIG. 5, of an alternate form of the invention; and FIG. **8*a* is also a broken section, similar to that of FIG. 8**, showing another form of the invention.
Figure 8A:
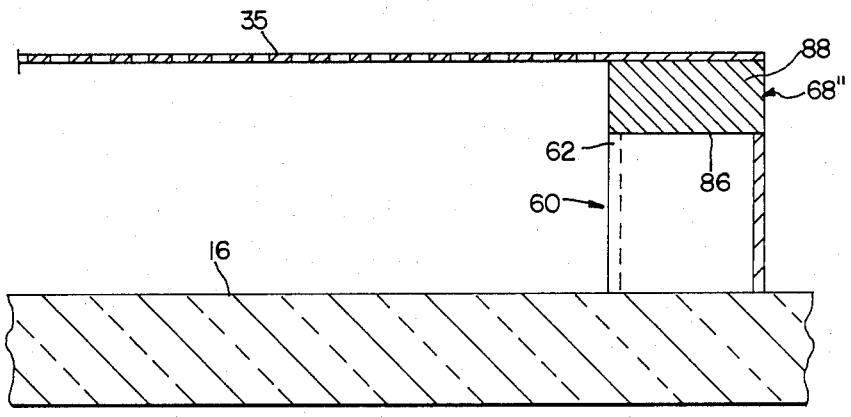

FIG. 8 shows an alternate form of the invention wherein cap 68' is generally L-shaped and includes a foot portion 80 which is flat for securing to top edge 62 of undulated strip 60, as by weld means. Leg 82 of cap 68' projects from the undulated strip and defines an elevated land 84 for securing the tension foil shadow mask thereto. Again, it can be seen that land 84 is offset or extends along the inside of the support structure nearest the centrally disposed phosphor screen so that the outside corners of the composite support structure surrounding the screen can be chamfered or rounded, similar to the illustration of FIG. 7, without disturbing the weld means at the inside corners of the support structure.

FIG. **8*a* shows another alternate form of the invention wherein a cap 68' adopts a generally rectangular block format (in cross-section) having a lower flat surface 86 which is secured to top edge 62 of undulated strip 60. Cap 68'' further comprises an extended land portion 88 to which the perimeter of tension mask is secured, preferably by weld means. The extended land area 88 atop cap 68''** insures that adequate space is available to permit a tool to engage and hold the mask perimeter in place on the land while readily permitting the weld means access to the portion of the mask adjacent the tool.

While particular embodiments of the invention have been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed is:

1. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension adjacent to and spaced from the faceplate, the support structure comprising an undulated member defining top and bottom sinuous edges, the bottom sinuous edge providing means for securing said undulated member to said inner surface of the faceplate, and the top sinuous edge providing means for securing the shadow mask to the support structure.

2. The front assembly of claim 1, including a plurality of said undulated members substantially surrounding the centrally disposed phosphor screen.

3. The front assembly of claim 2 wherein each said undulated member terminates in an end edge providing means for securing said undulated member to an end edge of a juxtaposed undulated member.

4. The front assembly of claim 1 wherein said undulated member has a generally uniform width, with said top sinuous edge being disposed in a plane generally parallel to the faceplate.

5. The front assembly of claim 4 wherein said undulated member comprises a strip of metal.

6. The front assembly of claim 1, including cap means defining land means extending along said top sinuous edge, said land means comprising a surface for securing said shadow mask thereto.

7. The front assembly of claim 6 wherein said cap means include a generally planar portion extending along said top sinuous edge and elevated above said top sinuous edge, said portion defining said land means.

8. The front assembly of claim 7 wherein said elevated portion of said cap means is located along the inside of said top sinuous edge nearest the centrally disposed phosphor screen.

9. The front assembly of claim 8, including a plurality of said undulated members and respective cap means substantially surrounding the centrally disposed phosphor screen and meeting at corner areas of the screen, the outside of said cap means being chamfered around said corners.

10. The front assembly of claim 6 wherein said cap means is generally U-shaped with leg portions overlying the sides of said undulated member.

11. The front assembly of claim 10 wherein said undulated member and said cap means are fabricated of metal material and said leg portions of said cap means are secured to the undulated member by weld means.

12. The front assembly of claim 6 wherein said undulated member and said cap means are fabricated of metal material and said cap means is secured to said undulated member by weld means.

13. The front assembly of claim 1 wherein said undulated member comprises a strip of metal.

14. The front assembly of claim 1 wherein the sides of said undulated member are flattened.

15. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension adjacent to and spaced from the faceplate, the support structure comprising a metal undulated strip having top and bottom sinuous edges, the bottom sinuous edge providing means for securing said metal undulated strip to said inner surfce of the faceplate, and the top sinuous edge providing means for securing the shadow mask to the support structure, the undulated strip having a generally uniform width whereby the top sinuous edge is disposed in a plane generally parallel to the faceplate.

16. The front assembly of claim 15, including a plurality of said undulated strips substantially surrounding the centrally disposed phosphor screen.

17. The front assembly of claim 15, including cap means defining land means extending along said top sinuous edge, said land means comprising a surface for securing said shadow mask thereto.

18. The front assembly of claim 17 wherein said cap means include a generally planar portion extending along said top sinuous edge and elevated above said top sinuous edge, said portion defining said land means.

19. The front assembly of claim 18 wherein said elevated portion of said cap means is located along the inside of said top sinuous edge nearest the centrally disposed phospor screen.

20. The front assembly of claim 19, including a plurality of said undulated strips and respective cap means substantially surrounding the centrally disposed phosphor screen and meeting at corner areas of the screen, the outside of said cap means being chamfered around said corners.

21. The front assembly of claim 17 wherein said cap means is generally U-shaped with leg portions overlying the sides of said undulated strip.

22. The front assembly of claim 21 wherein said cap means is fabricated of metal material and said leg portions of said cap means are secured to said undulated strip by weld means.

23. The front assembly of claim 17 wherein said cap means is fabricated of metal material and secured to said undulated strip by weld means.

24. The front assembly of claim 15 wherein the sides of said undulated strip are flattened.

* * * * *